US010354813B2

(12) United States Patent
Lee

(10) Patent No.: US 10,354,813 B2
(45) Date of Patent: Jul. 16, 2019

(54) ARC GAS VENTING STRUCTURE OF AIR CIRCUIT BREAKER

(71) Applicant: LSIS CO., LTD., Anyang-si, Gyeonggi-do (KR)

(72) Inventor: Kyu-Ho Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/946,347

(22) Filed: Apr. 5, 2018

(65) Prior Publication Data

US 2018/0294110 A1 Oct. 11, 2018

(30) Foreign Application Priority Data

Apr. 11, 2017 (KR) ..... 10-2017-0046868

(51) Int. Cl.
*H01H 9/34* (2006.01)
*H01H 73/18* (2006.01)
*H01H 71/02* (2006.01)

(52) U.S. Cl.
CPC ..... *H01H 9/342* (2013.01); *H01H 73/18* (2013.01); *H01H 71/025* (2013.01)

(58) Field of Classification Search
CPC .. H01H 9/342; H01H 2009/343; H01H 9/345; H01H 9/346; H01H 71/025; H01H 71/0235; H01H 71/40; H01H 73/18; H01H 31/02; H01H 33/08; H01H 71/128; H02B 11/127
USPC ..... 218/157, 35, 43; 200/306, 400
See application file for complete search history.

(56) References Cited

U.S. PATENT DOCUMENTS

| | | | | |
|---|---|---|---|---|
| 5,756,951 | A * | 5/1998 | Manthe | H01H 9/342 218/150 |
| 7,655,877 | B2 * | 2/2010 | Ahn | H01H 71/04 200/308 |
| 8,063,334 | B2 * | 11/2011 | Dahl | H01H 9/342 218/114 |
| 9,263,216 | B2 * | 2/2016 | Lin | H01H 9/48 |
| 2015/0015997 | A1 | 1/2015 | Faber et al. | |
| 2015/0129550 | A1 * | 5/2015 | Pochopien | H01H 9/0072 218/149 |
| 2015/0270075 | A1 | 9/2015 | Das et al. | |
| 2016/0217950 | A1 * | 7/2016 | Bresciani | H01H 33/10 |

FOREIGN PATENT DOCUMENTS

| | | | |
|---|---|---|---|
| CN | 1157053 | A | 8/1997 |
| CN | 101345165 | A | 1/2009 |
| CN | 103715027 | B | 11/2015 |
| EP | 2871659 | A1 | 5/2015 |
| JP | H0311511 | A | 1/1991 |

(Continued)

OTHER PUBLICATIONS

European Search Report for related European Application No. 18165458.3; report dated Sep. 6, 2018; (6 pages).

(Continued)

*Primary Examiner* — Edwin A. Leon
*Assistant Examiner* — William A Bolton
(74) *Attorney, Agent, or Firm* — K&L Gates LLP

(57) ABSTRACT

One or more arc gas outlet holes are formed in a trip device such that an effect of easily venting an arc gas, which flows into the trip device, to the outside through the arc gas outlet holes is provided.

7 Claims, 8 Drawing Sheets

(56) References Cited

FOREIGN PATENT DOCUMENTS

| | | | |
|---|---|---|---|
| KR | 20150039337 | A | 4/2015 |
| KR | 20160090688 | A | 8/2016 |
| KR | 20160117031 | A | 10/2016 |
| WO | 2015/009291 | A2 | 1/2015 |

OTHER PUBLICATIONS

Chinese Office Action for related Chinese Application No. 201810315282.2; dated Mar. 4, 2019; (7 pages).

* cited by examiner

[Fig. 1]
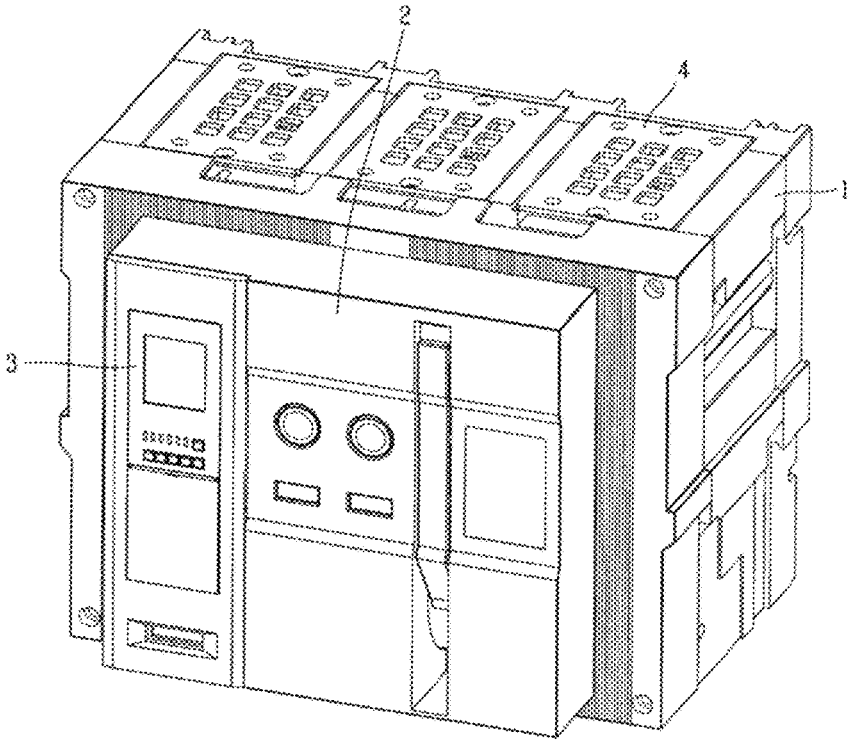
[PRIOR ART]

[Fig. 2]
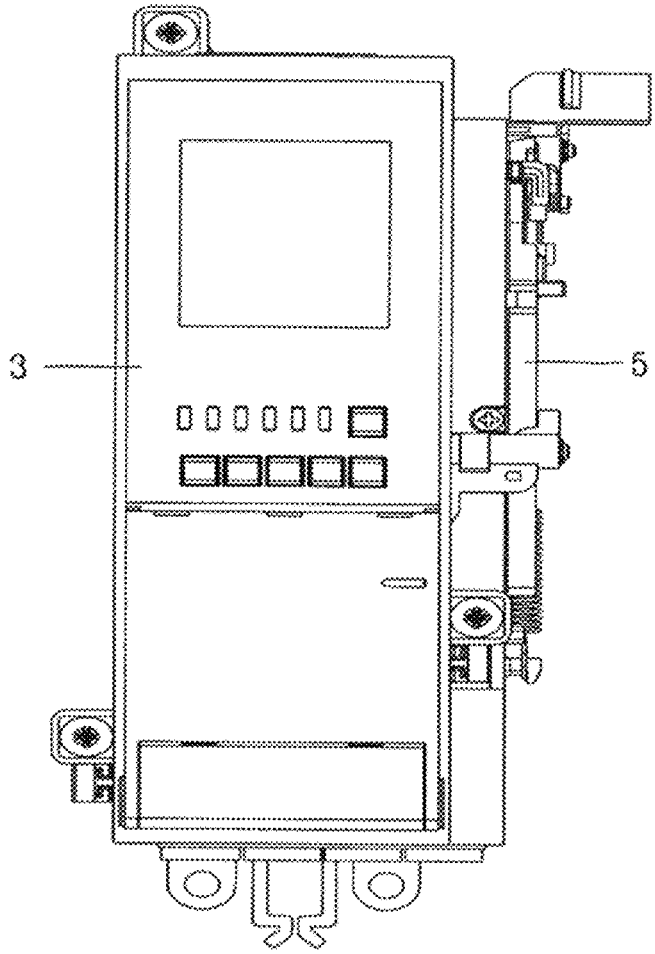
[PRIOR ART]

[Fig. 3]
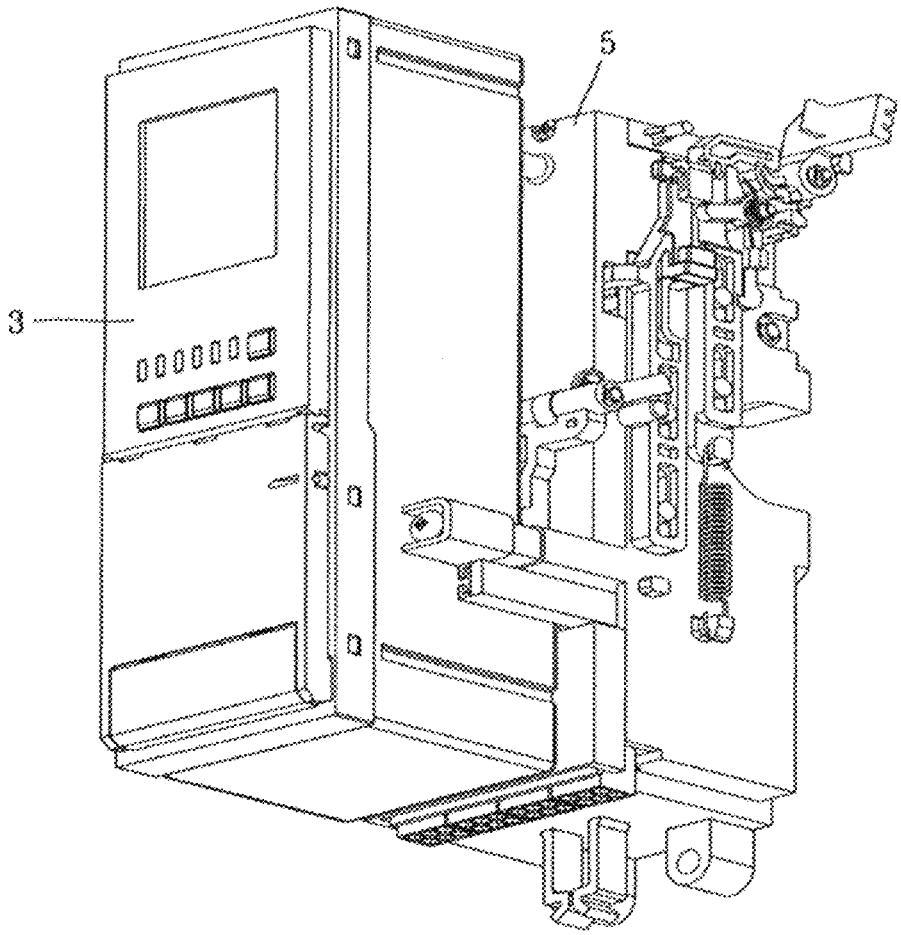
[PRIOR ART]

[Fig. 4]
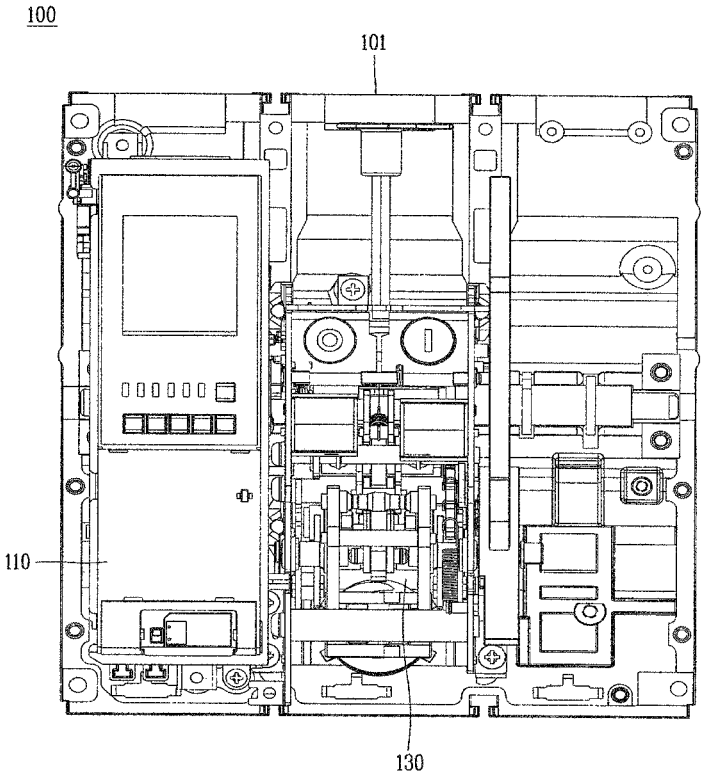

[Fig. 5]
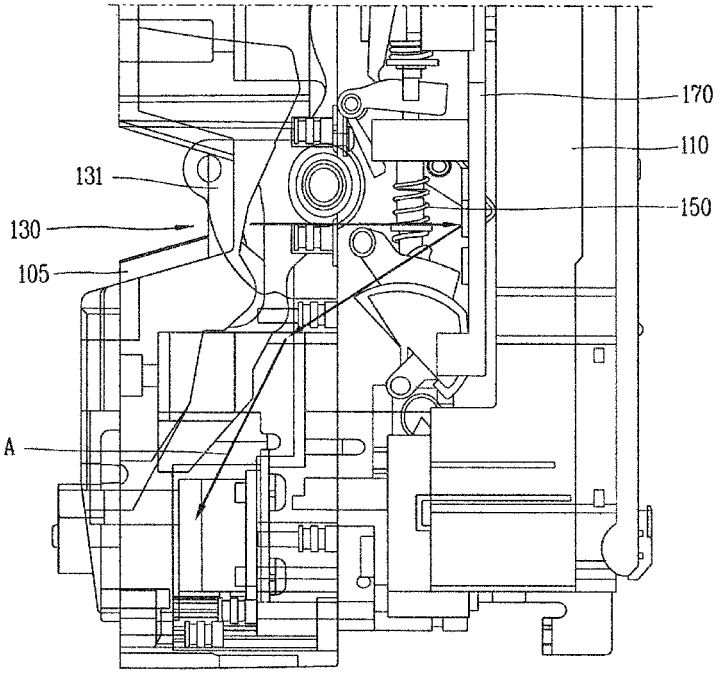

[Fig. 6]
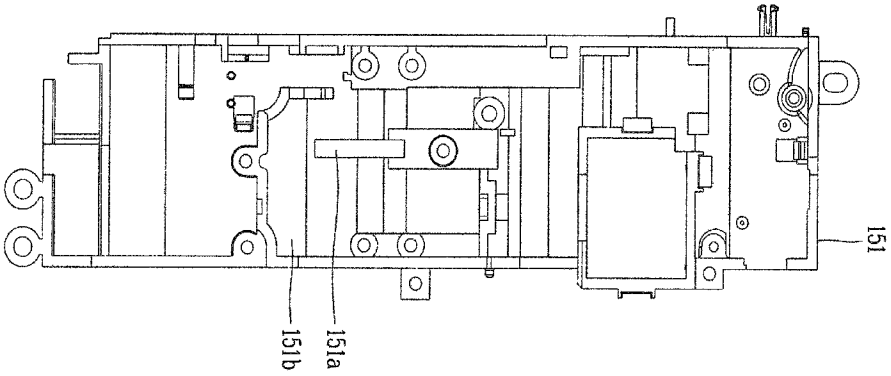

[Fig. 7]
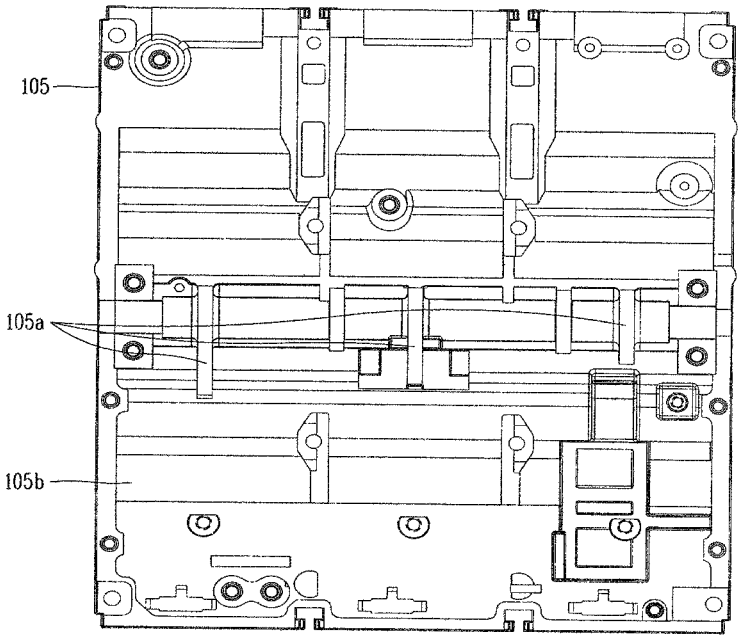

[Fig. 8]
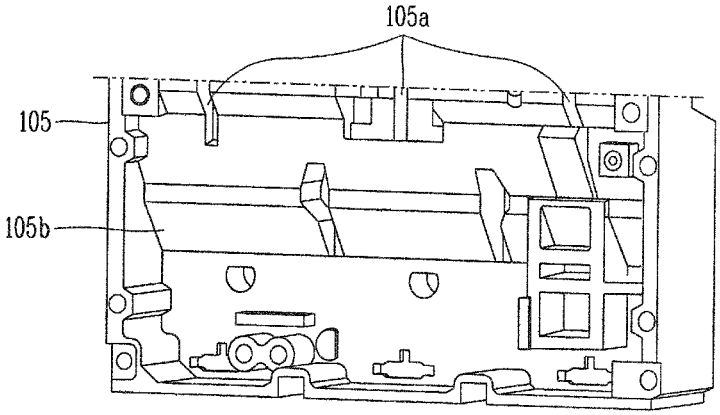

ARC GAS VENTING STRUCTURE OF AIR CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2017-0046868, filed on Apr. 11, 2017, the disclosure of which is incorporated herein by reference in its entirety.

BACKGROUND

1. Field of the Invention

The present invention relates to an arc gas venting structure of an air circuit breaker, and in more detail, to an arc gas venting structure of an air circuit breaker which easily discharges an arc gas, which is generated when a movable contact and a fixed contact are separated, to the outside.

2. Discussion of Related Art

Generally, an air circuit breaker is a sort of a circuit breaker which breaks a current when power is transmitted and mutated, an electric circuit and the like makes or breaks a load, or an accident such as grounding, short-circuit, or the like occurs, and is generally used for a low-pressure apparatus.

The air circuit breaker includes a switching mechanism which opens and closes a fixed contact and a movable contact, an over current relay which detects a fault current and outputs a trip command to break an inflow of a high current, and a mechanical trip device which is disposed between the switching mechanism and the over current relay and generates and transmits a mechanical operation force to the switching mechanism when the over current relay outputs the trip command.

Meanwhile, FIG. 1 is a perspective view of a conventional air circuit breaker, FIG. 2 is a front view illustrating a relay provided at the conventional air circuit breaker and a trip device connected thereto, and FIG. 3 is a perspective view illustrating the relay provided at the conventional air circuit breaker and the trip device connected thereto.

As shown in FIGS. 1 to 3, the air circuit breaker includes a body 1 which forms an accommodation space therein and a cover 2 coupled to a front of the body 1.

In the body 1, a fixed contact (not shown) and a movable contact, to which a bus bar and a load are connected, and a switching mechanism (not shown) which opens and closes the fixed contact and the movable contact are accommodated and installed.

Also, an arc quenching portion 4 is provided above the body 1 to vent an arc generated when the fixed contact and the movable contact are separated.

In addition, an over current relay 3, which detects a fault current or an over current and detects and breaks an inflow of a current which has a value higher than a preset current value when the current flows thereinto, is provided in front of the body 1. The cover 2 has an opening such that a front of the over current relay 3 is exposed.

Here, since the over current relay 3 performs important functions of detecting a fault current and outputting a trip command, periodic checkup and replacement are necessary.

Also, since it is impossible to perform functions of detecting a fault current and generating a trip command when the over current relay 3 is separated to be checked up or replaced, a separation is performed while a trip button is pushed such that the switching mechanism performs a trip operation.

Meanwhile, the over current relay 3 is assembled with a trip device 5 and transmits a trip command to the trip device 5 when the over current relay 3 detects an over current and a fault current.

Here, the switching mechanism performs a sending (ON) operation for applying an electric current or a trip (OFF) operation for breaking an electric current through the trip device 5.

That is, the over current relay 3 is used for detecting an over current and a fault current of the air circuit breaker, and the trip device 5 operates the switching mechanism to trip (OFF) the air circuit breaker according to a command given by the over current relay 3.

However, in the conventional air circuit breaker configured as described above, when the switching mechanism is operated by the over current relay 3 to break the fault current, it is necessary to vent an arc gas, which is generated when the movable contact and the fixed contact are separated, to the outside through the arc quenching portion 4. However, an internal pressure of the arc quenching portion 4 rapidly increases in a short time due to the arc gas. Also, due to the increase in the internal pressure of the arc quenching portion 4, the arc gas leaks into the trip device 5 and the over current relay 3 such that components of the trip device 5 and the over current relay 3 are seriously damaged due to a pressure of the arc gas.

Also, since the components of the trip device 5 and the over current relay 3 are damaged, an error occurs during operation when the air circuit breaker is used for a long period of time.

SUMMARY OF THE INVENTION

The present invention is directed to providing an arc gas venting structure of an air circuit breaker, which easily vents an arc gas generated when a movable contact and a fixed contact are separated, to the outside.

One aspect of the present invention provides an arc gas venting structure of an air circuit breaker, which includes a body having an accommodation space therein, an over current relay provided in front of the body, a trip device connected to the over current relay and configured to operate a switching mechanism, and the switching mechanism driven by the trip device to adjust contact or separation between a movable contact and a fixed contact. Here, the trip device includes a frame which forms an exterior, one or more arc gas inlet holes formed at the frame to allow an arc gas to flow into the trip device, and one or more arc gas outlet holes formed at the frame to vent the arc gas which has flowed into the trip device.

An incline may be formed below the body to be adjacent to the arc gas outlet holes.

The arc gas outlet holes may be formed to have a lateral length longer than a longitudinal length.

A bottom surface of the arc gas outlet hole may be formed to incline toward the incline.

The body may include a front frame which is located to be adjacent to the trip device and has a bottom at which the incline is formed such that a flow space of the arc gas vented through the arc gas outlet holes is provided through the incline.

The incline may be located below the arc gas outlet holes.

The arc gas venting structure may further include a breaking plate, which allows the arc gas which has flowed into the trip device to move toward the arc gas outlet holes on an inner side of the trip device toward the over current relay.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of a conventional air circuit breaker;

FIG. 2 is a front view illustrating a relay provided at the conventional air circuit breaker and a trip device connected thereto;

FIG. 3 is a perspective view illustrating the relay provided at the conventional air circuit breaker and the trip device connected thereto;

FIG. 4 is a front view of an air circuit breaker according to one embodiment of the present invention;

FIG. 5 is a side perspective view of the air circuit breaker according to one embodiment of the present invention;

FIG. 6 is a front view illustrating a frame of a trip device provided at the air circuit breaker according to one embodiment of the present invention;

FIG. 7 is a front view illustrating a state in which an incline is formed on a front frame provided at the air circuit breaker according to one embodiment of the present invention; and FIG. 8 is a perspective view illustrating the state in which the incline is formed on the front frame provided at the air circuit breaker according to one embodiment of the present invention.

DETAILED DESCRIPTION OF EXEMPLARY EMBODIMENTS

Hereinafter, an arc gas venting structure of an air circuit breaker according to one embodiment of the present invention will be described in detail with reference to the attached drawings.

FIG. 4 is a front view of the air circuit breaker according to an embodiment of the present invention, FIG. 5 is a side perspective view of the air circuit breaker according to one embodiment of the present invention, FIG. 6 is a front view illustrating a frame of a trip device provided at the air circuit breaker according to one embodiment of the present invention, FIG. 7 is a front view illustrating a state in which an incline is formed on a front frame provided at the air circuit breaker according to one embodiment of the present invention, and FIG. 8 is a perspective view illustrating the state in which the incline is formed on the front frame provided at the air circuit breaker according to one embodiment of the present invention.

As shown in FIGS. 4 and 5, an air circuit breaker 100 according to one embodiment of the present invention includes a body 101, an over current relay 110 located in front of the body 101, a trip device 150 located in the body 101 and connected to the over current relay 110, and a switching mechanism 130 which is driven through the trip device 150 and brings a movable contact and a fixed contact into contact with each other or separates them from each other.

The body 101 provides an accommodation space to accommodate components therein and accommodates the trip device 150, the switching mechanism 130, an arc quenching portion (not shown), and the like therein.

The over current relay 110 detects an inflow of current having a level higher than a preset current value, thereby detecting a fault current or an over current, and prevents the current from flowing into the air circuit breaker 100 by driving the switching mechanism 130.

The trip device 150 is disposed between the over current relay 110 and the switching mechanism 130 and generates and transmits a mechanical operating force to the switching mechanism 130 when a trip command of the over current relay 110 is output.

Here, as shown in FIG. 6, a frame 151 which forms an exterior of the trip device 150 includes a plurality of arc gas inlet holes 151*a*. The arc gas inlet holes 151*a* are configured to rotate a main shaft 131 formed in the switching mechanism 130.

Also, one or more arc gas outlet holes 151*b* are formed below the arc gas inlet holes 151*a* to vent an arc gas, which flows into the trip device 150 through the arc gas inlet holes 151*a*, to the outside. That is, the arc gas inlet holes 151*a* and the arc gas outlet holes 151*b* are formed in the same frame 151.

In a conventional case, an arc gas, which is generated when the movable contact and the fixed contact are separated, flows into the trip device 150 through the arc gas inlet holes 151*a* and applies a pressure to the trip device 150. The pressure influences an operating property of the trip device 150 as well as the over current relay 110 such that the over current relay 110 may malfunction.

However, according to the one embodiment of the present invention, one or more arc gas outlet holes 151*b* are formed below the arc gas inlet holes 151*a*. Accordingly, the arc gas, which pressurizes the trip device 150 through the arc gas inlet holes 151*a*, is vented outward from the trip device 150 through the arc gas outlet holes 151*b*. Accordingly, an influence of the arc gas on the trip device 150 is minimized.

Here, the arc gas outlet hole 151*b* may have a lateral length longer than a longitudinal length. A large amount of arc gas may be vented outward from the trip device 150 through the arc gas outlet holes 151*b*.

Additionally, as shown in FIGS. 7 and 8, the body 101 includes a front frame 105 located to be adjacent to the trip device 150.

The front frame 105 is located to face the trip device 150 and prevents the arc gas, which is generated when the movable contact and the fixed contact are separated, from flowing into the trip device 150. However, since arc leakage holes 105*a* are formed at the front frame 105 to rotate the main shaft 131 provided at the switching mechanism 130, the arc gas moves toward the trip device 150 through the arc leakage holes 105*a*.

Accordingly, the arc gas, which has moved toward the trip device 150 through the arc leakage holes 105*a*, flows into the trip device 150 through the arc gas inlet holes 151*a* and then is vented outward from the trip device 150 through the arc gas outlet holes 151*b*.

Meanwhile, an incline 105*b* is formed at the front frame 105 provided at the body 101 to be adjacent to the arc gas outlet holes 151*b*. That is, the incline 105*b* is formed on another frame (the front frame) not the frame 151 in which the arc gas inlet holes 151*a* and the arc gas outlet holes 151*b* are formed.

An adequate flow space through which the arc gas may move is formed below the front frame 105 through the incline 105*b*. Accordingly, the arc gas vented through the arc gas outlet holes 151*b* may adequately move in the front frame 105 to reduce the pressure thereof and be vented to the outside.

In addition, a bottom surface of the arc gas outlet hole 151*b* may be formed to incline, and the incline 105*b* may be formed to be located below the arc gas outlet holes 151*b*.

Accordingly, the bottom surface of the arc gas outlet hole 151*b* is formed to incline and the incline 105*b* is located below the arc gas outlet hole 151*b* such that the arc gas which has flowed into the trip device 150 is quickly vented toward the incline 105*b*.

Hereinafter, a process in which an arc gas is vented to the outside through the arc gas venting structure of the air circuit breaker 100 according to one embodiment of the present invention will be described in detail.

First, when the over current relay 110 detects an inflow of a fault current and operates the trip device 150, the switching mechanism 130 is operated by the trip device 150 to separate the movable contact and the fixed contact from each other such that the air circuit breaker 100 changes to a trip (OFF) state.

Here, when the fixed contact and the movable contact are separated, an arc gas A is generated. Here, the arc gas A is vented to the outside through the arc quenching portion and simultaneously moves toward the trip device 150 through the arc leakage holes 105*a* formed at the front frame 105.

The arc gas which has moved toward the trip device 150 flows into the trip device 150 through the arc gas inlet holes 151*a* formed at the trip device 150. The arc gas which flows into the trip device 150 is vented outward from the trip device 150 again through the arc gas outlet holes 151*b*.

Here, the pressure of the arc gas is not applied to the over current relay 110 connected to the trip device 150 due to a breaking plate 170 provided in the trip device 150.

Also, the arc gas vented outward from the trip device 150 through the arc gas outlet holes 151*b* freely moves through the space formed below the front frame 105 to reduce the pressure thereof through the incline 105*b* and is vented to the outside.

According to one embodiment of the present invention, the one or more arc gas outlet holes 151*b* are formed at the trip device 150 such that an arc gas which flows into the trip device 150 is easily vented to the outside through the arc gas outlet holes 151*b*. Accordingly, an influence applied to the trip device 150 or the over current relay 110 by the arc gas is minimized.

Also, since the arc gas outlet holes 151*b* have the lateral length longer than the longitudinal length, a large amount of arc gas is vented outward from the trip device 150 through the arc gas outlet holes 151*b* in a short time.

Also, the bottom surface of the arc gas outlet hole 151*b* is formed to incline, and the incline 105*b* formed on the front frame 105 is located below the arc gas outlet holes 151*b*. Accordingly, the arc gas vented through the arc gas outlet holes 151*b* is allowed to quickly move toward the incline 105*b*.

Also, since an adequate space through which the arc may move is secured through the incline 105*b* formed at the front frame 105, the arc gas freely moves in the front frame 105 such that a pressure of the arc gas is reduced.

According to the embodiments of the present invention, an arc gas venting structure of an air circuit breaker provides an effect of freely venting an air gas which flows into a trip device to the outside through at least one arc gas outlet hole formed at the trip device.

Also, the arc gas vent hole is formed to have a lateral length longer than a longitudinal length such that an effect of venting a large amount of arc gas through the arc gas vent hole in a short time may be provided.

Also, a bottom surface of the arc gas vent hole is formed to incline and an incline formed at a front frame is located below the arc gas outlet hole such that an effect of quickly moving the arc gas vented through the arc gas vent hole toward the incline to be vented outside may be provided.

Also, an adequate space for allowing the arc gas to flow is secured through the incline formed at the front frame such that an effect in which the arc gas freely flows in the front frame to reduce a pressure thereof may be provided.

Although an exemplary embodiment of the present invention has been described above, it is clear that the present invention may include a variety of changes, modifications, and equivalents thereof and the embodiment may be adequately modified to be equivalently applied. Accordingly, the scope of the present invention defined by the limitation of the following claims is not limited to the above description.

What is claimed is:

1. An arc gas venting structure of an air circuit breaker, which comprises a body having an accommodation space therein, an over current relay provided in front of the body, a trip device connected to the over current relay and configured to operate a switching mechanism, and the switching mechanism driven by the trip device to adjust contact or separation between a movable contact and a fixed contact, wherein the trip device comprises:

a frame which forms an exterior;

one or more arc gas inlet holes formed at the frame to allow an arc gas to flow into the trip device; and one or more arc gas outlet holes formed at the frame to vent the arc gas which has flowed into the trip device.

2. The arc gas venting structure of claim 1, wherein an incline is formed below the body to be adjacent to the one or more arc gas outlet holes.

3. The arc gas venting structure of claim 2, wherein the one or more arc gas outlet holes are formed to have a lateral length longer than a longitudinal length.

4. The arc gas venting structure of claim 3, wherein a bottom surface of the one or more arc gas outlet holes is formed to incline toward the incline.

5. The arc gas venting structure of claim 2, wherein the body comprises a front frame which is located to be adjacent to the trip device and has a bottom at which the incline is formed such that a flow space of the arc gas vented through the one or more arc gas outlet holes is provided through the incline.

6. The arc gas venting structure of claim 5, wherein the incline is located below the one or more arc gas outlet holes.

7. The arc gas venting structure of claim 1, further comprising a breaking plate, which allows the arc gas which has flowed into the trip device to move toward the one or more arc gas outlet holes on an inner side of the trip device toward the over current relay.

* * * * *